US009130300B2

(12) United States Patent
Wu et al.

(10) Patent No.: US 9,130,300 B2
(45) Date of Patent: Sep. 8, 2015

(54) WATER RESISTANT CONNECTOR

(71) Applicant: GiMer Medical Co. Ltd., Taipei (TW)

(72) Inventors: Chen-Tun Wu, Taipei (TW); Chan-Yi Cheng, Taipei (TW); Chi-Heng Chang, Taipei (TW)

(73) Assignee: GiMer Medical Co., Ltd., New Taipei (TW)

( * ) Notice: Subject to any disclaimer, the term of this patent is extended or adjusted under 35 U.S.C. 154(b) by 117 days.

(21) Appl. No.: 14/096,941

(22) Filed: Dec. 4, 2013

(65) Prior Publication Data

US 2015/0155648 A1 Jun. 4, 2015

(51) Int. Cl.
*H01R 13/68* (2011.01)
*H01R 13/52* (2006.01)

(52) U.S. Cl.
CPC ..... *H01R 13/5202* (2013.01)

(58) Field of Classification Search
CPC ..... H01R 13/59
USPC ..... 439/461, 462, 587, 589, 805, 909; 607/37
See application file for complete search history.

(56) References Cited

U.S. PATENT DOCUMENTS 1,181,451 A * 5/1916 Hubbell ..... 439/462
2,564,302 A * 8/1951 Fraser ..... 174/653
3,567,843 A * 3/1971 Collins et al. ..... 174/51
3,621,413 A * 11/1971 Wolfgang ..... 439/462
3,757,789 A * 9/1973 Shanker ..... 607/37
3,760,332 A * 9/1973 Berkovits et al. ..... 439/381
3,904,812 A * 9/1975 Daffron ..... 174/549
4,136,897 A * 1/1979 Haluch ..... 285/342
4,310,001 A * 1/1982 Comben ..... 607/37
4,513,172 A * 4/1985 Matsui ..... 174/655
4,686,738 A * 8/1987 Bladh ..... 174/152 G
4,704,103 A * 11/1987 Stober et al. ..... 604/175
4,784,141 A * 11/1988 Peers-Trevarton ..... 607/37
5,125,915 A * 6/1992 Berry et al. ..... 604/533
5,257,622 A * 11/1993 Hooper et al. ..... 607/37
5,261,395 A * 11/1993 Oleen et al. ..... 607/15
5,405,172 A * 4/1995 Mullen, Jr. ..... 285/92
5,413,595 A * 5/1995 Stutz, Jr. ..... 607/37
5,543,582 A * 8/1996 Stark et al. ..... 174/653
5,766,042 A * 6/1998 Ries et al. ..... 439/668
5,872,335 A * 2/1999 Mullen, Jr. ..... 174/653
5,920,035 A * 7/1999 Haney et al. ..... 174/652
5,951,595 A * 9/1999 Moberg et al. ..... 607/37
6,102,753 A * 8/2000 Lindegren ..... 439/848
6,149,455 A * 11/2000 Levi ..... 439/462
6,164,997 A * 12/2000 Davies ..... 439/320

(Continued)

*Primary Examiner* — Neil Abrams
(74) *Attorney, Agent, or Firm* — Muncy, Geissler, Olds & Lowe, P.C.

(57) ABSTRACT

A water resistant connector jointing with a housing, comprises a base, a sleeve plug disposed in the base, a clamping member disposed in the base and a locking member. The sleeve plug contacts with the neck portion of the base. The locking member is locked at the housing and contacts with the clamping member. The transmission line passes through the locking member, the clamping member, and the sleeve plug such that one portion of the transmission line is exposed at the exterior of the base. The locking member moves linearly and extrudes the clamping member and the sleeve plug such that the sleeve plug has deformation by the extrusion from the neck portion of the base. The effects of water resistance and seal may be achieved by using the sleeve plug to tightly joint with the internal wall of the base and the transmission line.

10 Claims, 5 Drawing Sheets

(56) References Cited

U.S. PATENT DOCUMENTS

| | | | | |
|---|---|---|---|---|
| 6,390,843 | B1 * | 5/2002 | Lim | 439/346 |
| 6,910,906 | B2 * | 6/2005 | Schorn | 439/274 |
| 7,008,269 | B2 * | 3/2006 | Riley et al. | 439/668 |
| 7,156,681 | B2 * | 1/2007 | Kaneda et al. | 439/332 |
| 7,711,429 | B1 * | 5/2010 | Lim | 607/37 |
| 8,208,978 | B2 * | 6/2012 | Stiehl et al. | 455/575.2 |
| 8,579,652 | B2 * | 11/2013 | Flach | 439/462 |
| 8,597,042 | B2 * | 12/2013 | King | 439/341 |
| 8,738,151 | B2 * | 5/2014 | Nelson | 607/116 |
| 8,972,012 | B2 * | 3/2015 | Lim | 607/37 |
| 2009/0221188 | A1 * | 9/2009 | Gao et al. | 439/676 |

* cited by examiner

WATER RESISTANT CONNECTOR

BACKGROUND

1. Technical Field

The disclosure relates to a water resistant connector, and more particularly to a water resistant connector capable of waterproof sealing, and preventing the transmission line from loosing.

2. Related Art

Currently, electrical devices are widely applied in every field with the development of the electronics technology. Implantable medical electronic devices become prevalent recently. For assurance of the safety and lifespan, the implantable medical electronic devices must be capable of preventing water from entering inside. Thus, the connector plug on the electronic devices or the holes on the housing of the electronic devices must be tightly sealed to achieve water resistance. Thus, moisture can be prevented from entering the interior electronic devices from the holes on the housing, and the oxidation of the electrical elements or damages on the circuitry can be avoided. In particular, for the implantable medical electronic devices, the designers must be more careful about the water resistance mechanism to avoid dangers to the patients.

Waterproof rubber rings are generally configured in the conventional electrical devices to seal the gap in the connector to achieve water resistance such that the moisture may be prevented from entering to the electrical devices. However, for the implantable medical electronic devices used for minimally invasive implant surgery, the external diameter of the electrode line must be less than the internal diameter of the guide pin. For the tiny electrode lines configured with the general waterproof rubber ring, no other mechanism may extrude the waterproof rubber ring to achieve tight sealing. Thus, the moisture still enters to the devices from the gap between the electrode lines and the connector, and then penetrates into the interior of the electrical devices. Thus the electrical components in the implantable medical electronic devices become wet, oxidized, or damaged, and the devices may further cause dangers to the patients.

SUMMARY

Exemplary embodiments of the disclosure disclose a water resistant connector.

A water resistant connector, according to some embodiments of the disclosure, jointing with a housing and passed through by a transmission line having a positioning member, comprises a base, a sleeve plug, a clamping member and a locking member. A first opening is formed at one side of the base and a second opening is formed at the other side of the base. The first opening of the base corresponds to the opening of the housing. An accommodating space is formed in the base. A neck portion is configured adjacent to the second opening in the accommodating space. The neck portion may be formed a cone shape. The sleeve plug and the clamping member are respectively disposed in the base. One side of the sleeve plug contacts with the neck portion of the base and the other side contacts with the clamping member. The clamping member corresponds to the first opening of the base. The locking member is locked at the housing and contacts with the clamping member. The transmission line passes through the locking member, the clamping member, and the sleeve plug such that one portion of the transmission line is exposed at the exterior of the base. The locking member moves linearly and extrudes the clamping member and the sleeve plug such that the sleeve plug has deformation by the extrusion from the neck portion of the base. The technical effects of water resistance and sealing may be achieved by way of using the sleeve plug to tightly joint with the internal wall of the base and the transmission line. The moisture penetration into the housing from the opening may be prevented. Further, the transmission line comprises a positioning member. The clamping member corresponds to the positioning member such that the transmission line may be secured and positioned when the transmission line passes through the base. Thus the transmission line may be prevented from loosing from the base.

For a fuller understanding of the nature and objects of the invention, reference should be made to the following detailed description taken in connection with the accompanying drawings.

BRIEF DESCRIPTION OF THE DRAWINGS

The present disclosure will become more fully understood from the detailed description given herein below for illustration only, and thus are not limitative of the present disclosure, and wherein.

Figure 1:
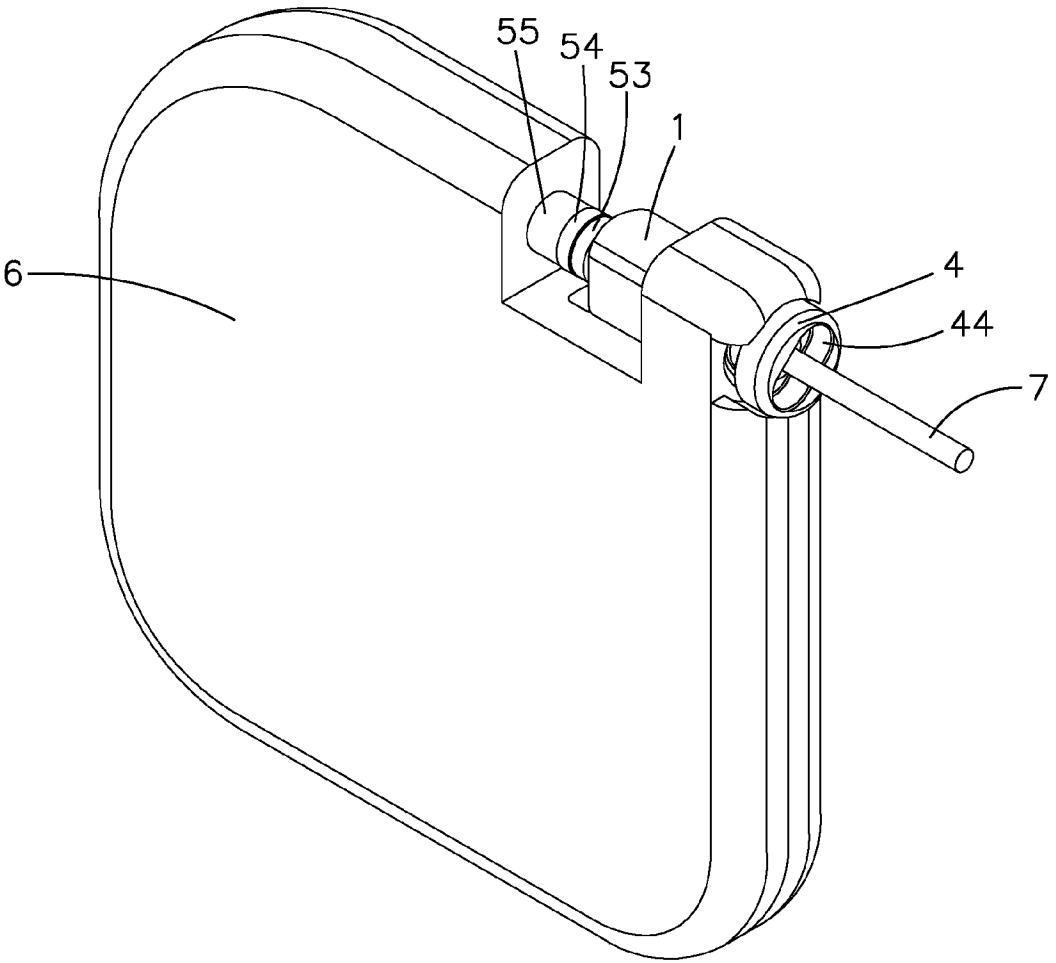
FIG. 1 illustrates the schematic diagram of the water resistant connector of the embodiment of the disclosure.
Figure 2:
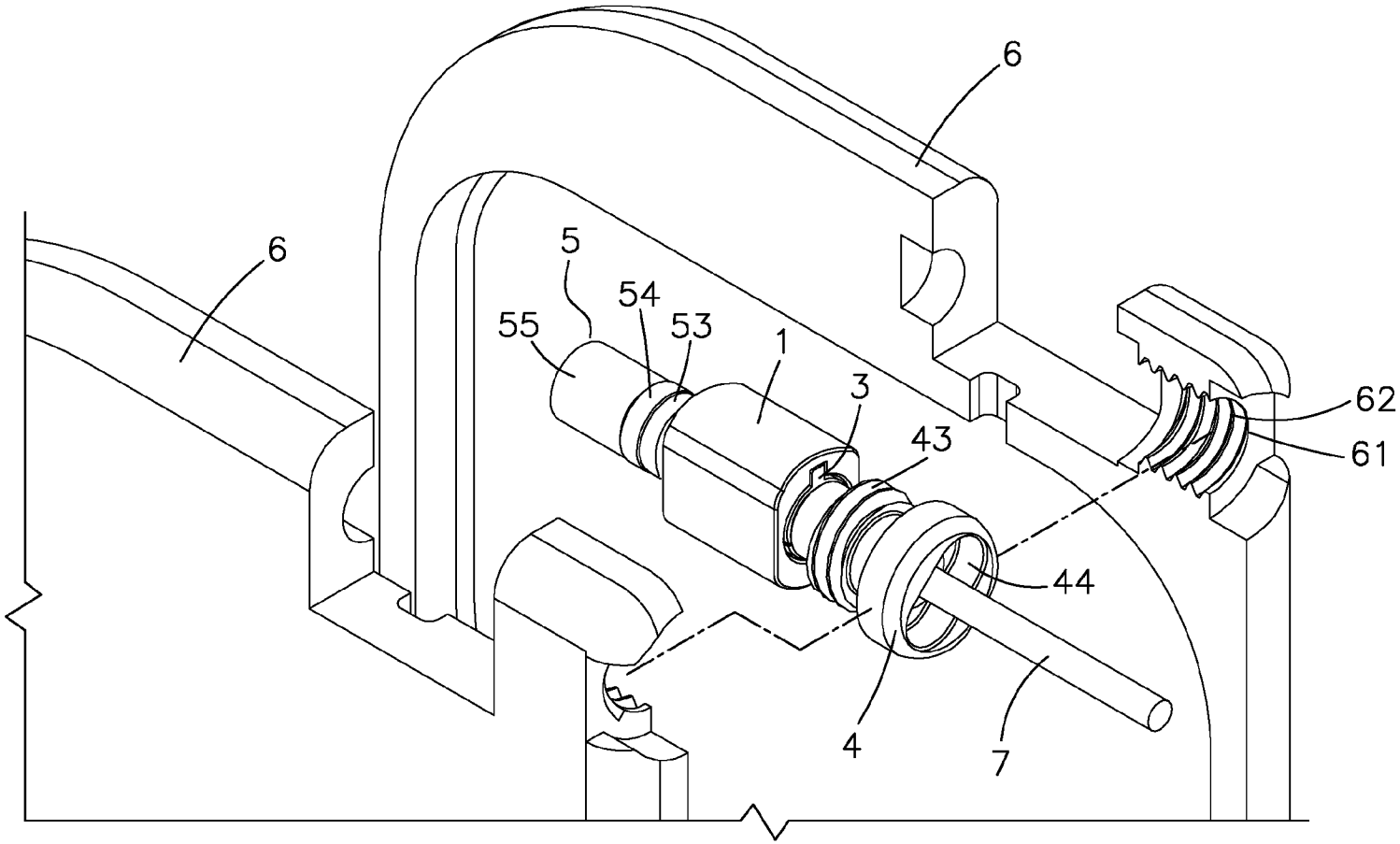
FIG. 2 illustrates the exploded view of the water resistant connector of the embodiment of the disclosure.
Figure 3:
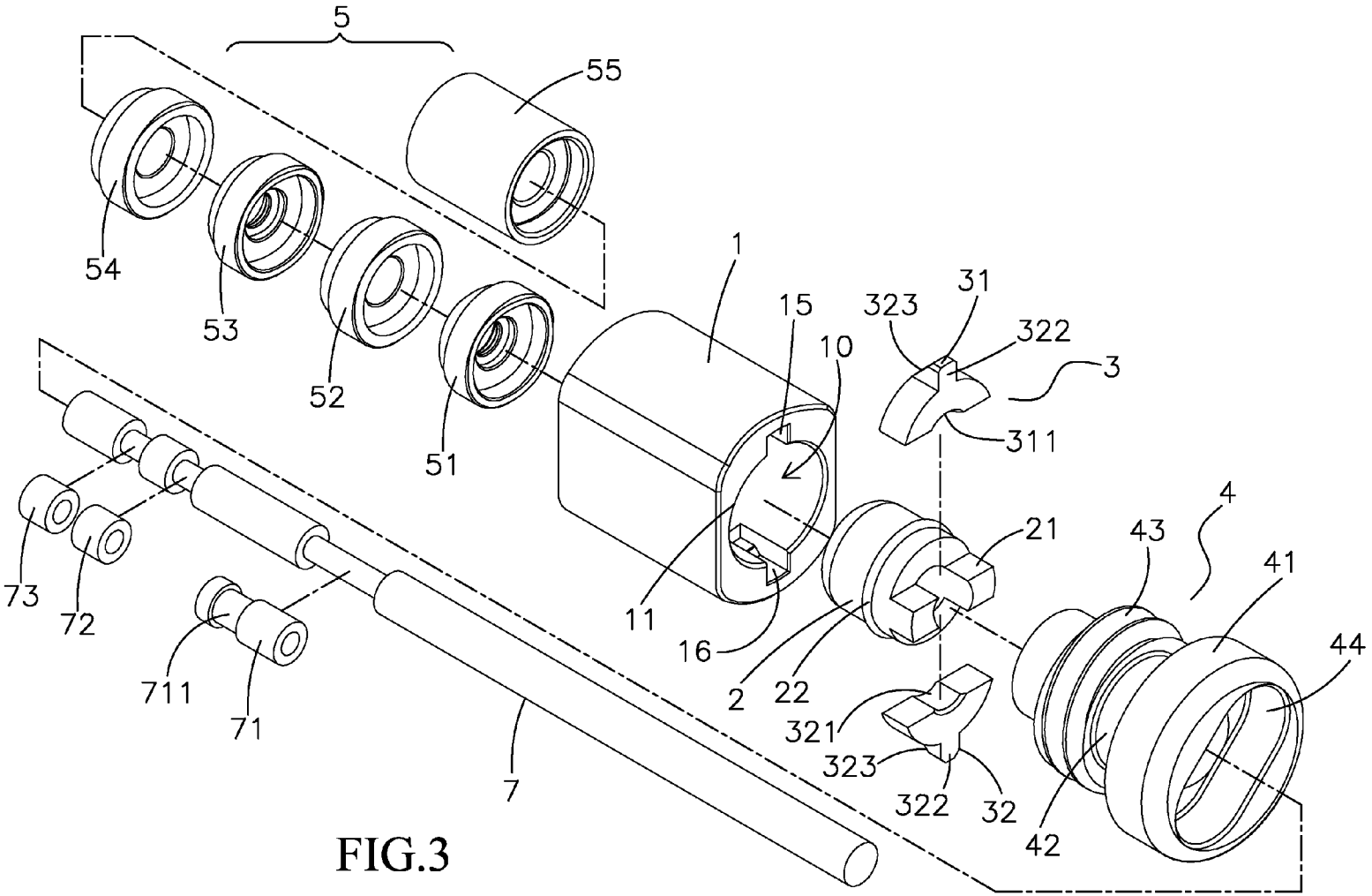
FIG. 3 illustrates the exploded view of the water resistant connector of the embodiment of the disclosure.
Figure 4:
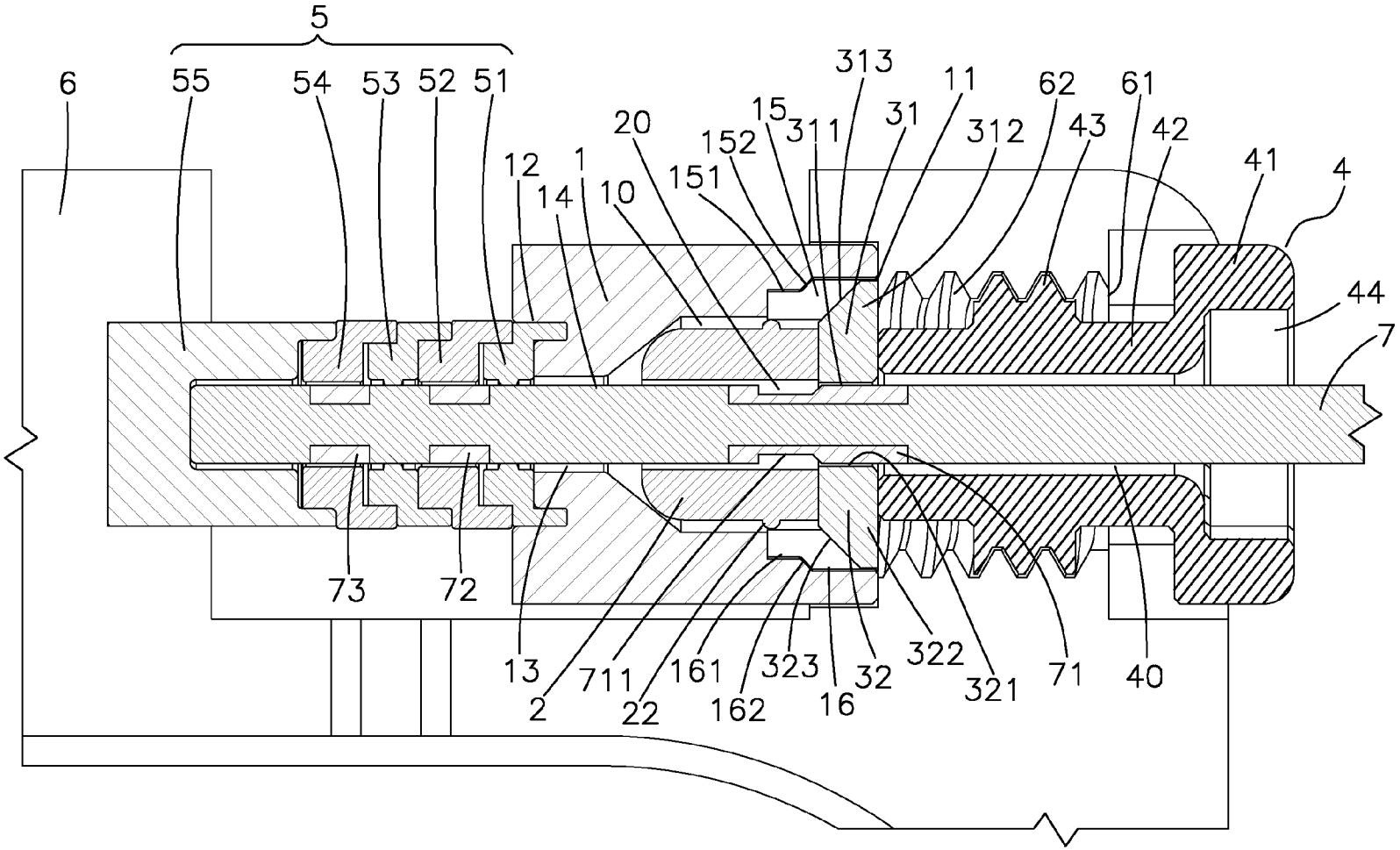
FIG. 4 illustrates the operation of the water resistant connector of the first embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DETAILED DESCRIPTION

The detailed characteristics and advantages of the disclosure are described in the following embodiments in details, the techniques of the disclosure can be easily understood and embodied by a person of average skill in the art, and the related objects and advantages of the disclosure can be easily understood by a person of average skill in the art by referring to the contents, the claims and the accompanying drawings disclosed in the specifications.

Refer to FIG. 1 to FIG. 5 illustrating the water resistant connector of the embodiment of the disclosure. The water resistant connector is configured on the housing 6 of an electrical device. The housing 6 comprises a third opening 61. The internal wall of the third opening 61 is formed with a second locking portion 62. A transmission line 7 may be configured in the water resistant connector of the disclosure. The transmission line 7 comprises a positioning member 71 having a third recess 711. The water resistant connector of the embodiment comprises a base 1, a sleeve plug 2, a clamping member 3, a locking member 4 and an electroconductive member 5.

The base 1 may be configured inside of the housing 6. A first opening 11 is formed on one side of the base 1 and a second opening 12 is formed on the other side of the base 1. The first opening 11 corresponds to the third opening 61 of the housing 6. The base 1 has an accommodating space 10. The accommodating space 10 communicates with the first opening 11. The accommodating space 10 communicates with the second opening 12 through a passage 13. A neck portion 14 is configured adjacent to the passage 13 in the accommodating space 10. The neck portion 14 may be formed a cone shape. The side of the small diameter of the neck portion 14 is toward the second opening 12 and the side of large diameter of the neck portion 14 is toward the first opening 11. A first guide slot 15 and a second guide slot 16 are configured adjacent to the first opening 11 in the accommodating space 10. A first stopper 151 is formed at the junction of the first guide slot 15 and the accommodating space 10. A first slope 152 is formed at where the first stopper 151 faces the first opening 11. A second stopper 161 is formed at the junction of the second guide slot 16 and the accommodating space 10. A second slope 162 is formed at where the second stopper 161 faces the opening 11.

The sleeve plug 2 is configured in the accommodating space 10 of the base 1. A first through hole is formed in the sleeve plug 2. One side of the sleeve plug 2 contacts with the necking 14 of the base 1 and the other side of the sleeve plug 2 are formed to have two first protrusions 21 corresponding to each other. A second protrusion 22 is formed at the outer surface of the sleeve plug 2 to encircle the sleeve plug 2. The second protrusion 22 contacts with the accommodating space 10 tightly. The sleeve plug 2 may be a flexible member, whose material may be silicone or polyurethane, such that the sleeve plug 2 has deformation by the extrusion of the neck portion 14 of the base 1.

The clamping member 3 is configured in the accommodating space 10 of the base 1. The clamping member 3 comprises a first clamping block 31 and a second clamping block 32. The first clamping block 31 and the second clamping block 32 are configured in the accommodating space 10 of the base 1 and contact with the sleeve plug 2. The first clamping block 31 is semi-circular shape. One side of the first clamping block 31 is formed to have a first recess 311 and the other side of the first clamping block 31 is formed to have a third protrusion 312. The third protrusion 312 corresponds to the first guide slot 15 of the base 1. The third protrusion 312 is formed to have a third slope 313 corresponding to the first stopper 151. The third slope 313 corresponds to the first slope 152. The second clamping block 32 forms a semi-circular shape. One side of the second clamping block 32 is formed to have a second recess 321 and the other side of the second clamping block 32 is formed to have a forth protrusion 322. The second recess 321 corresponds to the first recess 311. The forth protrusion 322 corresponds to the second guide slot of the base 1. The forth protrusion 322 is formed to have a forth slope 323 corresponding to the second stopper 161. The forth slope 323 corresponds to the second slope 162. The first clamping block 31 and the second clamping block 32 correspond to the two sides of the first protrusion 21 of the sleeve plug 2. The first recess 311 of the first clamping block 31 and the second recess 321 of the second clamping block 32 respectively correspond to the third recess 711 of the positioning member 71 of the transmission line 7.

The locking member 4 joints with the third opening 61 of the housing 6. The locking member 4 comprises a base portion 41. One side of the base portion 41 has an extension potion 42 contacting with the clamping member 3. A first locking portion 43 is formed on the outer surface of the extension potion 42 of the locking member 4. The first locking portion 43 joints with the second locking portion 62 of the housing 6. A second through hole 40 passing through the base portion 41 and the extension portion 42 is formed in the locking member 41. A recess 44 is formed at the other side of the base 41 of the locking member 4. In one embodiment, the first locking portion 43 and the second portion 62 may be threads such that the first locking portion 43 and the second portion 62 may lock with each other. Thus the locking member 4 may move in linear way and be positioned. In another embodiment, the first locking portion 43 may be a recess (or a protrusion), and the second locking portion 42 may be a protrusion (or a recess). Thus the locking member 4 may move in linear way and be positioned by way of engagement. An external object may be placed in the recess 44 to rotate the locking member 4.

The electroconductive member 5 joints with the second opening 12 of the base 1. The electroconductive member 5 comprises a ring body 51, a first electroconductive ring body 52, a second ring body 53, a second electroconductive ring body 54, and a seal member 55. The ring body 51, the first electroconductive ring body 52, the second ring body 53, the second electroconductive ring body 54, and the seal member 55 joint together sequentially. Then the first ring body 51 joints with the second opening 12 of the base 1.

A transmission line 7 passes through the water resistant connector of the disclosure. The transmission line 7 comprises a positioning member 71 having a third recess 711. The transmission line 7 further comprises a first transmitting member 72 and a second transmitting member 73. The transmitting member 7 passes through the second through hole 40 of the locking member 4, the clamping member 3, the first through hole 20 of the sleeve plug 2, and the accommodating space 10 and the passage 13 of the base 1 such that a portion of the transmitting member 7 is exposed at the exterior of the base 1. The exposed portion of the transmitting member 7 then passes through the electroconductive member 5. The base 1 and the electroconductive member 5 encircle and seal the transmitting member 7. The first transmitting member 72 of the transmitting member 7 electrically connects with the first electroconductive ring body 52 of the electroconductive member 5. The second transmitting member 73 of the transmitting member 7 electrically connects with the second electroconductive ring body 54 of the electroconductive member 5.

Figure 5:
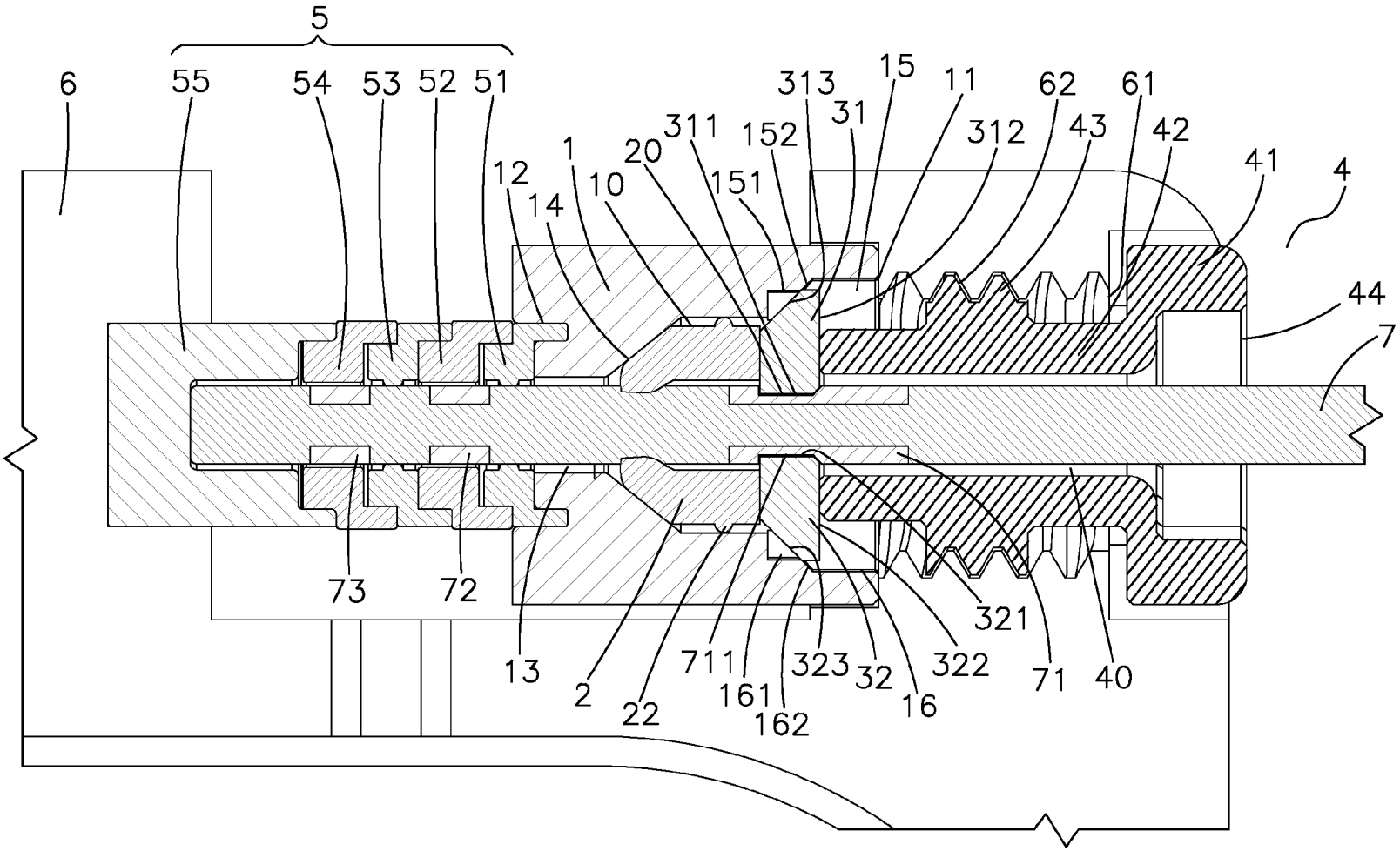
FIG. 5 illustrates the operation of the water resistant connector of the second embodiment of the disclosure.

The locking member 4 moves linearly to extrude the clamping member 3 and the sleeve plug 2. As shown in FIG. 5, when the sleeve plug 2 extrudes toward the second opening 12, one side of the sleeve plug 2 is extruded by the neck portion 14 of the base 1 to have deformation. The deformation of the sleeve plug 2 is used to tightly joint the internal wall of the accommodating space 10 of the base 1 and the transmission line 7. The technical effects of water resistance and sealing for the base 1 may be achieved. Further, by way of enabling the second protrusion 22 on the outer surface of the sleeve plug 2 to tightly contact the accommodating space 10 of the base, the effect of the water resistance may be also achieved. Thus, the short circuit of the internal circuitry in the electrical device caused by the moisture penetration into the housing 6 of the electrical device through the base 1 from the third opening 61 of the housing 6 may be prevented.

When the locking member 4 moves linearly and extrudes the clamping member 3 and the clamping member 3 moves toward the second opening 12, the third protrusion 312 of the first clamping block 31 and the third slope 3 contact with the first stepper 151 and the first slope 152, and the forth protrusion 322 of the second clamping block 32 and the forth slope 323 contact with the second stopper 161 and the second slope 162 such that the first clamping block 31 and the second clamping block 32 respectively tapered toward the direction of the transmission line 7. From the time being, the first recess 311 of the first clamping block 31 and the second recess 321 of the second clamping block 32 respectively correspond to clamp the third recess 711 of the positioning member 71 of the transmission line 7, as shown in FIG. 5. This the transmission line 7 may be secured and positioned when passing through the base 1 and loosing from the base 1 may be prevented for the transmission line 7. Further, when the clamping member 3 moves to the third protrusion 312 of the first clamping block 31, the top surface of the third protrusion 312 aligns with the surface of the first stepper 151, and the top surface of the forth protrusion 322 aligns with the surface of the second stepper 161. When the locking member 4 continues moving linearly and extruding the clamping member 3, the first clamping block 31 and the second clamping block 32 of the clamping member 3 stop to taper toward the direction of the transmission line 7. Thus the damage of the transmission line 7 caused by over extrusion of the transmission line 7 from the first clamping block 31 and the second clamping block 32 of the clamping member 3 may be prevented.

Note that the specifications relating to the above embodiments should be construed as exemplary rather than as limitative of the present invention, with many variations and modifications being readily attainable by a person skilled in the art without departing from the spirit or scope thereof as defined by the appended claims and their legal equivalents.

What is claimed is:

1. A water resistant connector, disposed in a housing having a third opening, and a second locking portion formed on the internal wall of the third opening, a transmission line passing through the water resistant connector, the water resistant connector comprising:

a base disposed in the housing, a first opening formed at one side of the base and a second opening formed at the other side of the base, wherein the first opening corresponds to the third opening of the housing; wherein an accommodating space is formed in the base, the accommodating space communicating with the first opening, the accommodating space communicating with the second opening through a passage; wherein a neck portion is configured adjacent to the passage in the accommodating space, a first guide slot and a second guide slot are configured adjacent to the first opening in the accommodating space, a first stopper is formed at the junction of the first guide slot and the accommodating space, and a second stopper formed at the junction of the second guide slot and the accommodating space;

a sleeve plug configured in the accommodating space of the base, wherein sleeve plug comprises a first through hole, one side of the sleeve plug contacting with the neck portion of the base, the sleeve plug having deformation by the extrusion of the neck portion of the base;

a clamping member having a first clamping block and a second clamping block, the first clamping block and the second clamping block configured in the accommodating space of the base and contacting with the sleeve plug, one side of the first clamping block formed to have a first recess and the other side of the first clamping block formed to have a third protrusion, the third protrusion corresponding to the first guide slot, the third protrusion formed to have a third slope corresponding to the first stopper, one side of the second clamping block formed to have a second recess and the other side of the second clamping block formed to have a forth protrusion, the second recess corresponding to the first recess, the forth protrusion corresponding to the second guide slot, the forth protrusion formed to have a forth slope corresponding to the second stopper; and a locking member jointing with the third opening of the housing, the locking member comprising a base portion, one side of the base portion having an extension potion, and a second through hole passing through the base portion and the extension portion, a first locking portion formed in the extension potion, the first locking portion jointing with the second locking portion of the housing, the extension portion contacting with the clamping member, the locking member moving linearly and extruding the clamping member and the sleeve plug;

wherein the transmission line passing through the second through hole of the locking member, the clamping member, the first through hole of the sleeve plug, and the accommodating space and the passage of the base sequentially such that one portion of the transmission line is exposed at the exterior of the base.

2. The water resistant connector according to claim 1, wherein a positioning member is configured in the transmission line, the transmission line having a third recess, the first recess of the first clamping block and the second recess of the second clamping block respectively clamping the third recess of the positioning member.

3. The water resistant connector according to claim 1, wherein the sleeve plug is a flexible member, at least one second protrusion formed to encircle the outer surface of the sleeve plug, the second protrusion and the accommodating space tightly contacting with each other.

4. The water resistant connector according to claim 3, wherein the material of the sleeve plug is silicone.

5. The water resistant connector according to claim 3, wherein the material of the sleeve plug is polyurethane.

6. The water resistant connector according to claim 1, wherein the neck portion is formed to be a cone shape, the side of the small diameter of the neck portion being toward the second opening and the side of large diameter of the neck portion being toward the first opening.

7. The water resistant connector according to claim 1, wherein a first slope is formed at where the first stopper faces the first opening, a second slope is formed at where the second stopper faces the opening, the first slope corresponding to the third slope of the first clamping block, the second slope corresponding to the forth slope of the second clamping block.

8. The water resistant connector according to claim 1, further comprising an electroconductive member jointing with the second opening of the base, the electroconductive member comprising a ring body, a first electroconductive ring body, a second ring body, a second electroconductive ring body, and a seal member, the ring body, the first electroconductive ring body, the second ring body, the second electroconductive ring body, and the seal member jointing together sequentially and then the first ring body jointing with the second opening of the base, the transmission line passing through the base and the electroconductive member, the transmission line further comprising a first transmitting member and a second transmitting member, the first transmitting member electrically connecting with the first electroconductive ring body, the second transmitting member of the transmitting member electrically connecting with the second electroconductive ring body.

9. The water resistant connector according to claim 1, wherein the first locking portion and the second portion are formed as threads such that the first locking portion and the second portion lock with each other, the locking member moving in linear way and being positioned.

10. The water resistant connector according to claim 1, wherein the first locking portion is a recess, the second locking portion is a protrusion, the first locking portion and the second locking portion engaging with each other, the locking member moving in linear way and being positioned.

* * * * *